US006554447B1

(12) United States Patent
Kotary et al.

(10) Patent No.: US 6,554,447 B1
(45) **Date of Patent: *Apr. 29, 2003**

(54) CANDLE PRODUCT DECORATED WITH HEAT-SHRINKABLE FILM AND RELATED METHOD

(75) Inventors: Kara L. Kotary, Racine County, WI (US); Sandra E. Blevins-Steer, Racine County, WI (US); M. Scott Carpenter, Kenosha County, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/550,285

(22) Filed: Apr. 14, 2000

(51) Int. Cl.[7] ..... F23D 3/16; F21V 35/00; F21L 19/00

(52) U.S. Cl. ..... 362/161; 362/806; 431/288; 431/289; 206/497; 428/34.9; 428/35.1; 428/339

(58) Field of Search ..... 362/161, 806, 362/351, 180, 182; 206/497; 439/289, 288, 253, 296; 428/34.9, 332, 339, 35.1; 528/272

(56) References Cited

U.S. PATENT DOCUMENTS

| | | | | |
|---|---|---|---|---|
| 1,660,760 A | | 2/1928 | Murphy | |
| 2,001,377 A | | 5/1935 | Candy, Jr. | 67/22 |
| 2,050,151 A | | 8/1936 | Baumer | 240/13 |
| RE20,434 E | | 7/1937 | Barrett, Jr. | 67/21 |
| 2,137,707 A | | 11/1938 | Wade et al. | 67/21 |
| 3,126,682 A | | 3/1964 | Krance | 53/30 |
| 3,829,348 A | | 8/1974 | Spiegal | 161/16 |
| 3,867,625 A | | 2/1975 | Whalen | 240/13 |
| 4,225,049 A | | 9/1980 | Inoue | 215/12 R |
| 4,704,843 A | | 11/1987 | Owen et al. | 53/450 |
| 4,818,214 A | * | 4/1989 | Ronnback | 431/35 |
| 4,947,299 A | | 8/1990 | Lin | 362/161 |
| 5,264,995 A | | 11/1993 | McKee | 362/161 |
| 5,683,762 A | | 11/1997 | Banschick | 428/4 |
| 5,849,375 A | | 12/1998 | Smith et al. | 428/34.5 |
| 5,879,151 A | | 3/1999 | Schultz et al. | 431/291 |
| 5,879,496 A | | 3/1999 | Bright et al. | 156/86 |
| 5,932,685 A | | 8/1999 | Mori et al. | 528/272 |
| 5,948,257 A | | 9/1999 | Custer et al. | 210/500.26 |
| 5,953,170 A | | 9/1999 | Glancy | 359/896 |
| 5,962,368 A | | 10/1999 | Poole | 503/227 |
| 5,985,387 A | | 11/1999 | Mori et al. | 428/34.9 |
| 6,003,287 A | | 12/1999 | Ballestrazzi et al. | 53/546 |
| 6,020,823 A | | 2/2000 | DeCicco | 340/691.2 |
| 6,036,024 A | | 3/2000 | Seidler | 206/780 |

FOREIGN PATENT DOCUMENTS

| | | | |
|---|---|---|---|
| GB | 1033320 | * | 6/1966 |
| JP | 7-216384 | * | 8/1995 |

* cited by examiner

*Primary Examiner*—Thomas M. Sember

(57) ABSTRACT

A decorated candle product includes one of a candle and a candle holder containing the candle. A decorative web of a heat-shrinkable polymer web is heat shrunk to conform to a shape of the one of the candle and the candle holder. The web has a decorative feature located to cooperate with light emitted by the candle to augment the visual effect created when the candle is lit.

20 Claims, 2 Drawing Sheets

CANDLE PRODUCT DECORATED WITH HEAT-SHRINKABLE FILM AND RELATED METHOD

FIELD OF THE INVENTION

This invention, in general, relates to decorated candle products, and more particularly relates to candle products decorated by the application of a decorative heat-shrinkable film either to the candles or to candle holders in which the candles are situated.

BACKGROUND OF THE INVENTION

Candles and candle products come in many shapes, sizes, and designs. Some candles are intended to stand alone, while others are intended to be held upright in the form of candlesticks or the like. Other candles are intended to be situated in candle holders. In the case of so-called gel candles and some wax candles, the candles can substantially fill the volume of holders in which the candles are situated.

In any of these cases, it is desirable to decorate the candle products to improve their aesthetics—for both when a candle is displayed and when it bums. However, it can be difficult and costly to decorate the exterior surface of a candle or its holder. Also, many known techniques do not provide flexibility in production to easily change the particular decorative design. This limits the ability to provide cost-effectively a variety of designs or to tailor the designs to a specific season, event, motif, holiday or the like.

Therefore, there is a need in the art for a cost-effective candle decorating method which permits greater flexibility in production to allow a change from among varied decorative designs, and provides a decorative candle product.

It has long been known to encase candles in protective material. For example, U.S. Pat. No. 2,137,707 (Wade, et al.) relates to a process for packaging tapered candles in a seamless casing formed of a non-fibrous, cellulosic material. The casing may be transparent, translucent and/or colored. In one embodiment, the non-fibrous, cellulosic material is formed into a tube. The tube is wetted to soften the material for application to the candle. The wet tube diameter is substantially equal to the mean diameter of the tapered candle. The wet tube is pushed down onto the candle, stretching as necessary to fit over the wider end of the candle. Then, the covered candle is dried, and the tube forms a protective casing that conforms closely to the shape of the candle.

It has also been known to wrap candles in heat-shrinkable films for shipping and display. U.S. Pat. No. 3,126,682 (Krance) relates to a method of wrapping candles. A tube of heat-shrinkable film material is loosely formed about the candle by shaping a web of the material about the candle with overlapping longitudinal edges. By grasping the tube just beyond each end of the candle, the wrapped candle is carried past a heat source, by which the material is heat shrunk around the candle. The material selected has two important characteristics: it will not shrink any further once it contacts the surface of the candle, and it holds a high charge of static electricity which causes it to cling when overlapped. Thus, the material is not heat sealed, but rather is held together statically around the candle.

It has also been known to apply heat-shrinkable wraps on various objects for decorative purposes. For example, U.S. Pat. No. 3,829,348 (Spiegel et al.) relates to decorative three-dimensional objects such as ornaments or glassware.

The object is decorated by heat-shrinking a decorated tube or band of heat-shrinkable plastic about the object. The tube is decorated by applying precut patterns, silk screening, striping or the like. The plastic is preferably polyvinyl chloride (PVC) or polyethylene, which is uniaxially oriented, resulting in a 30–50% diametric shrinkage versus only a 2–10% height shrinkage of the tube.

However, it has not previously been proposed to decorate a candle product such as a candle or a candle holder with a heat-shrinkable film that is decorated in a manner to cooperate with the light emitted by the candle to provide a pleasing, altered or otherwise augmented visual effect. Further, it has not been suggested to decorate a candle or holder, which will be subject to elevated temperatures during normal use, by application of a heat-shrinkable film. The known art does not suggest such an application, nor does it suggest with any certainty that heat-shrinkable polymers could be used to decorate such a combustible product.

Therefore, there is a need in the art for a candle decorating method and decorative candle product, which utilize heat-shrinkable films to provide a design that cooperates with the light emitted by the candle to achieve such a visual effect.

SUMMARY OF THE INVENTION

The present invention addresses the foregoing needs in the art by providing a product and method in which a candle is decorated by enveloping the candle (or holder) in a decorative, heat-shrinkable polymer wrap and heat-shrinking the wrap about the candle (or holder).

In one aspect, the present invention relates to a method of decorating a candle product, and includes the steps of providing a web of a heat-shrinkable polymer having a decorative feature and encasing with the web one of a candle and a candle holder. After the encasing step, the web is heated to shrink the web to conform to a shape of the one of the candle and the candle holder. In a case in which the one of the candle and the candle holder is the candle holder, a candle can be inserted into the candle holder.

In another aspect, the present invention relates to a decorated candle product including one of a candle and a candle holder containing the candle. A decorative web of a heat-shrinkable polymer web is heat shrunk to conform to a shape of the one of the candle and the candle holder. The web has a decorative feature located to cooperate with light emitted by the candle to augment the visual effect created when the candle is lit.

These and other aspects, objects, features, and advantages will be more evident from the following description and drawings, in which like reference numerals relate to like elements throughout.

DETAILED DESCRIPTION OF THE PREFERRED EMBODIMENTS

Figure 1A:
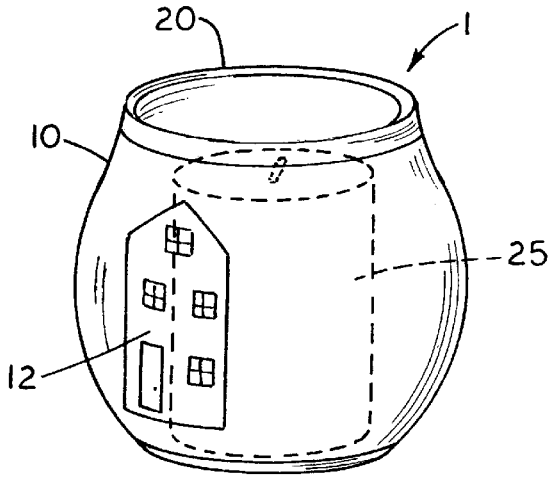
FIG. 1A is a perspective view of a decorated candle product according to one embodiment of the present invention.
Figure 1B:
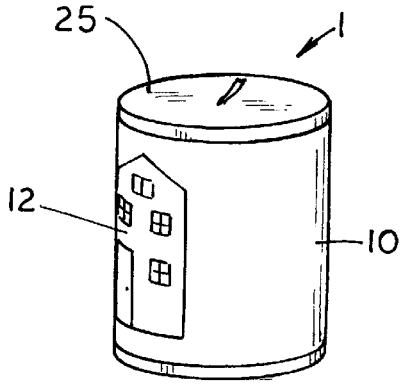
FIG. 1B is a perspective view of a decorated candle product according to another embodiment of the present invention.

FIGS. 1A and 1B illustrate two embodiments of a decorated candle product 1 formed in accordance with the present invention. In each embodiment, the candle product 1 is decorated by enveloping the candle product 1 in a decorative, heat-shrinkable polymer wrap 10 and heat-shrinking the wrap 10 about the candle product 1. As shown in FIG. 1A, the wrap 10 can be heat shrunk to a candle holder 20 in which a candle 25 is carried. Alternatively, as shown in FIG. 1B, the wrap 10 can be heat shrunk directly to the candle 25.

The wrap 10 is provided with a design 12 that should not only improve the appearance of the candle 25 or holder 20, but should cooperate with light emitted by by the candle 25 (for example, be illuminated by the light) to augment the visual effect created when the candle 25 is lit. For example, the base wrap 10 may be colored and translucent. This will augment any surface features (e.g., fillets, flutes or the like) of a candle holder 25 in a similar manner as would tinted glass. Alternatively, the wrap 10 may be selectively transparent, translucent and/or opaque to provide a desired light pattern when the candle 25 is lit. The design 12 can be provided by any of a number of suitable processes, such as printing (including using metallic, Day-Glo®, glow-in-the-dark, thermochromatic or other inks) or finishing (including providing gloss, matte, or other specialty finishes).

In the embodiment illustrated in FIG. 1A, in which the wrap 10 is applied to the holder 20, the candle 25 disposed in the holder 20 can be formed of wax, gel or other suitable candle-forming material. Additionally, the candle 20 could be any combustible fragrance delivery or illumination device that is wick based and burns a hydrocarbon-based fuel.

We had initial concerns about whether heat-shrinkable polymers could be used to decorate such a combustible product. However, we have found that the preferred wrap material, poly(ethylene terephthalate) (PET), withstands the expected conditions (e.g., extended exposure to temperatures of about 100 to about 150° F.) of use, and performs acceptably when exposed to such non-standard conditions as flare-ups (during which temperatures can approach about 450 to 500° F.), misaligned wraps, and the like. Although this material is preferred, the wrap material may be any of a number of suitable heat-shrinkable polymer films, including PVC, polyethylene, polystyrene, other polyesters, and the like, so long as the film is not adversely affected by the temperatures encountered during normal candle use. Further, if the wrap 10 is to be applied directly to the candle 25, we prefer that the wrap film be heat-shrinkable at sufficiently low temperatures or brief exposure times so that the candle 25 itself will experience little or no melting during the shrinking process.

Figure 3:
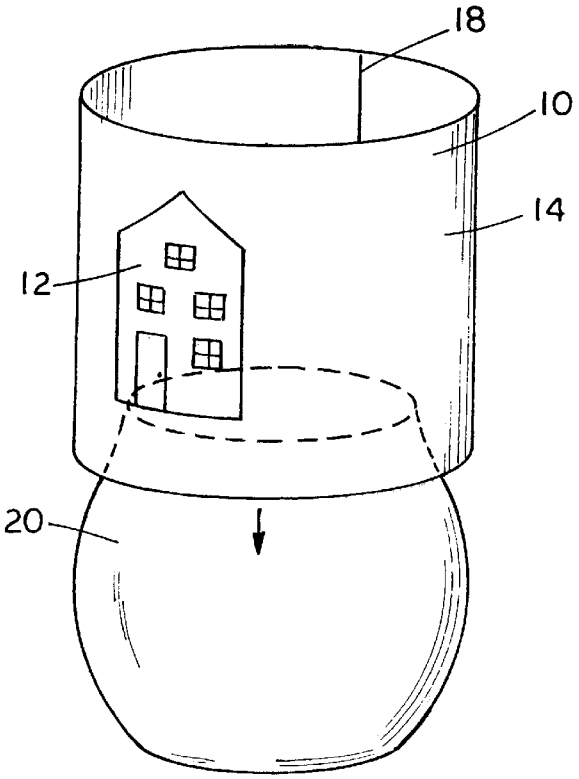
FIG. 3 is a perspective view illustrating a step in the candle product decorating method according to one embodiment of the present invention.
Figure 4:
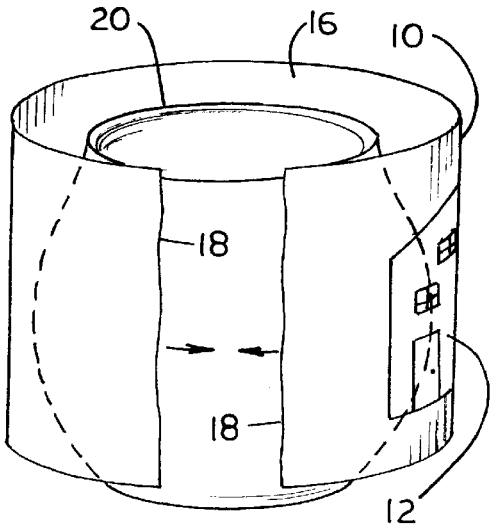
FIG. 4 is a perspective view illustrating a step in the candle product decorating method according to another embodiment of the present invention.
Figure 2B:
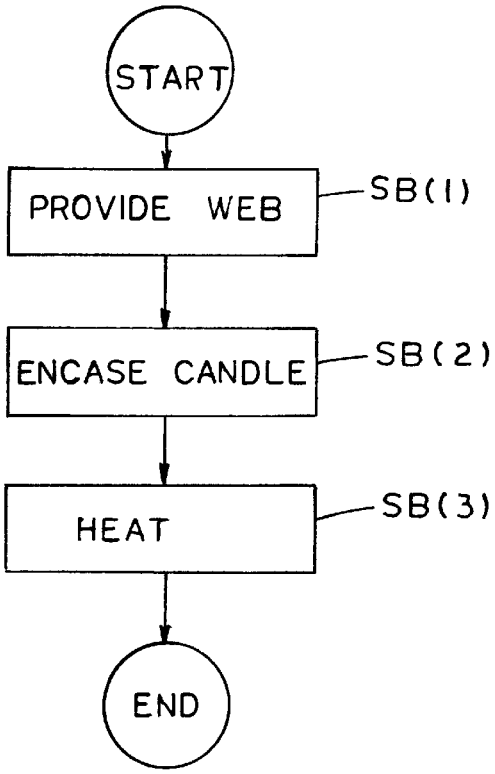
FIG. 2B is a flow chart illustrating a candle product decorating method according to another embodiment of the present invention.
Figure 2A:
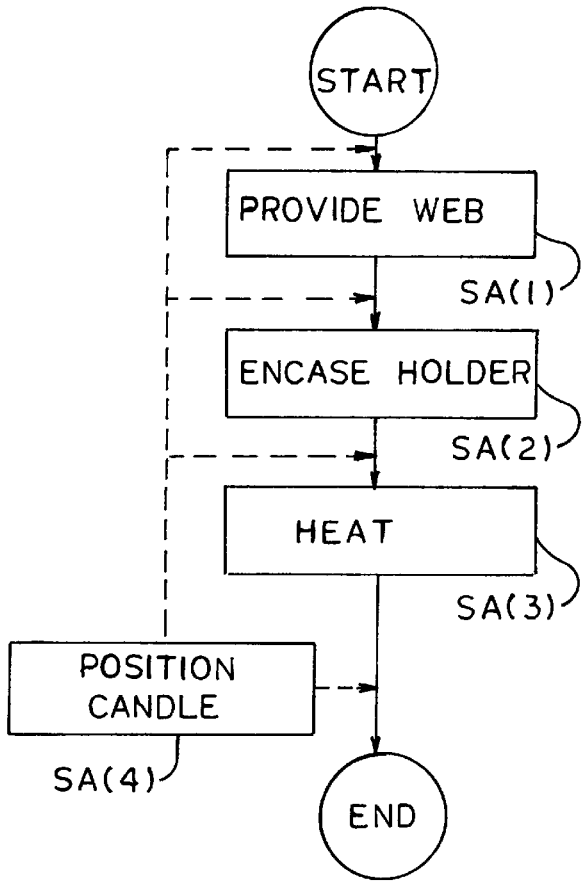
FIG. 2A is a flow chart illustrating a candle product decorating method according to one embodiment of the present invention.
Figure 5:
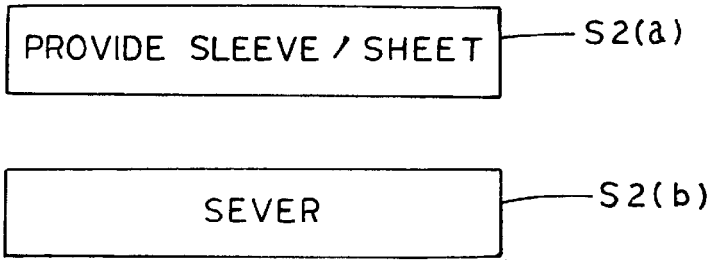
FIG. 5 is a flow chart illustrating in more detail a preferred embodiment of a step in a candle product decorating method according to one embodiment of the present invention.

Referring to FIGS. 2A and 2B, the decorating processes for the wrapped-holder and directly-wrapped-candle embodiments, respectively, each includes the step of providing a web of wrap film (steps SA(1) and SB(1)). Preferably, but not necessarily, the wrap film will be provided in individual pieces: preformed, closed loops or bands 14 that fit over a candle 25 or holder 20 (as shown in FIG. 3) or panels 16 that are wrapped about a candle 25 or holder 20 (as shown in FIG. 4). In each of these cases, as shown in FIG. 5, the step of providing the web (step SA(1) or SB(1)) can include the steps of providing a continuous sleeve or sheet (step S2(a)) and severing the sleeve or sheet into the individual pieces (step S2(b)). Alternatively, the web can be cut into pieces later in the process, such as after the web encases the candle product 1 (discussed below).

In any case, the edges 18 of the film are overlapped and seamed in a known manner, either before (in the case of bands 14) or after (in the case of panels 16) application to the candle holder 20 or candle 25. For example, the edges 18 may be solvent sealed, heat sealed, or the like. In the case of bands 14, the edges are joined at sleeve formation, which in a preferred embodiment is done by joining opposing transverse edges of a "continuous" web of the film by tetrahydronfuran (THF) solvent applied in a known manner. Also, the design 12 preferably will be applied to the film before it is severed into individual pieces. In the case of bands 14 (as shown in FIG. 3), the design 12 is preferably applied to the continuous web in advance of the sleeve formation.

The film of the wrap 10 may be oriented so as to shrink predominantly in a single direction, thereby improving the predictability of the shrink-wrapping process.

This can be accomplished in a known manner. For example, prior to formation of the individual pieces, while the film still comprises in a generally "continuous" web, the film can be heated and stretched in one direction. Usually this will be done in the cross-machine direction (transverse to the length of the continuous web). When the film is heated again later, in a heat-shrinking process, the film will shrink predominantly in the direction in which it has been stretched. Although not necessary to the invention, it would be preferable to orient the film so as to shrink about the candle product 1 to a much greater extent in the circumferential rather than axial direction. This facilitates orientation of the film relative to the candle 25 or holder 20.

The not-yet-shrunk film can be placed loosely about the candle 25 or holder 20, and the top or bottom edge of the film can be aligned substantially with its intended final position. As the film shrinks (predominantly circumferentially), the film will close tightly about the candle 25 or holder 20 without undue axial displacement of the top and bottom edges of the film.

The preferred PET film is about 50 microns thick and is oriented transversely so as to exhibit the following shrinkage characteristics when submersed in heated water for thirty seconds:

| Water | Shrinkage (%) | |
|---|---|---|
| Temperature (° C.) | Machine direction | Cross-machine direction |
| 80 | <4 | 50–60 |
| 100 | <3 | >70 |

The individual bands 14 or panels 16 for application to each candle 25 or holder 20 can be produced by severing the continuous sleeve or sheet (step S2(b)) at a timing metered by the output of a photosensor. The photosensor can be employed to detect predetermined registration markers on the sleeve or web, in order to ensure that the sleeve or web is severed at appropriate intervals given the design 12 on the film. (If desired, the photosensor detection "window" can be limited to specified time periods in a known manner.) If the decorative design 12 is a repeating pattern, then the photosensor can key on a specific aspect of the pattern. If the design is not repeating or repeats less frequently than every cutting interval, then a standard registration marker can be provided. For example, a clear box with a specified border can be incorporated into each design 12 at the same location in the individual band 14 or panel 16. This permits a single web to bear more than one design 12, resulting in bands 14 or panels 16 that differ from one another in design. This greatly increases the ease and cost-effectiveness of producing candle products 1 decorated with varied designs.

Returning to FIGS. 2A and 2B, in step SA(2) and SB(2), the holder 20 or candle 25 is encased by the heat-shrinkable wrap. (See FIGS. 3 and 4.) In the preferred embodiment, this is done with a band 14 or wrapped panel 16 that is slightly larger in circumference than the target candle 25 or holder 20. In the case of, for example, a candle holder 20 that is not cylindrical (i.e., it is wider in some places than others), the band 14 or wrapped panel 16 should be slightly larger in circumference than the widest part of the candle holder 20. This, however, is not necessary; the band 14 or panel 16 can be stretched onto a larger candle holder 20 if desired.

The height of the band 14 or panel 16 can be very close to the desired height of the finished design on the candle 25 or holder 20. As noted, an oriented film can be used in known manner to provide a band 14 that shrinks predominately in the circumferential direction, with very limited shrinkage in the axial direction.

A typical band 14 will be described for application to a curved holder 20 that is approximately 68.6 mm tall and has a side wall that is approximately 70.6 mm in diameter at its mouth, bulges to approximately 80.8 mm in diameter (approximately 253.8 mm in circumference) at its widest point, and tapers to approximately 40.5 mm in diameter at its base. The elongated sleeve, from which the bands 14 are formed, is approximately 260.75 mm in circumference (corresponding to approximately 83.0 mm in diameter). The sleeve is severed transversely into bands 14 that are approximately 71.0 mm in height. Thus, each band 14 is approximately 7.0 mm larger in circumference than the holder 20. Each band 14 is also approximately 2.4 mm taller than the holder 20. However, due to the rounded side wall of the holder 20, the actual distance along the side wall from top-to-bottom actually exceeds the height of the band 14 by a few millimeters.

The thus-formed band 14 is then placed over the candle holder 20 (see FIG. 3). At this stage of the process for wrapping a candle holder 20 (illustrated in FIG. 2A), it is preferred that no candle 25 be present, although this is not necessary to the invention. This permits the holder 20 to be oriented upside-down on a carrying surface (such as a conveyor belt or tray) for band application. This provides several advantages. In this orientation, the band 14 can rest against the carrying surface at the outset of heat-shrinking. This prevents the wrap 10 from overlapping the mouth of the holder 20. It also provides a reference surface to keep wrap 10 from skewing relative to the holder 20. A secondary advantage is that the absence of the candle 25 at this stage avoids subjecting candle 25 to the elevated temperatures of the heat-shrinking process, which could result in some softening or melting (although the melting can be kept to a minimum, as in the case of the application of the wrap 10 directly to a candle 25).

It should be noted that the candle 25 may be positioned in the holder 20 (step SA(4) in FIG. 2A) earlier in the process, and may be present before the wrap 10 is applied to the holder 20. For example, in the case of gel-candles or pour-in wax candles, the candle may be poured into the holder 20 at any point in the process, as shown by the dashed lines in FIG. 2A. In fact, it is possible that the candle may be at such a temperature when poured into the holder, that the candle itself can contribute to or achieve the heating step (discussed below).

In the case of application of a wrap 10 directly to a candle 25 (FIG. 2B), it is preferred to orient the candle 25 upright. This makes it easier to orient the wrap 10 so that it does not interfere with the wick. This also minimizes the effect on the wick of whatever small degree of melting that might occur during heat-shrinking.

Once the band 14 or panel 16 is positioned about the candle 25 or holder 20, the combination can be fed by any known mechanism (e.g., a conveyor belt) into a heating station, where the band 14 or panel 16 is heat shrunk onto the candle 25 or holder 20 (steps SA(3) and SB(3)). The heating station can apply hot, dry air; hot, humid air or steam; or some sequential combination of hot air and steam. The sequential combination is preferred in order to best avoid wrinkles and bubbles in the finished wrap 10, in a manner well known in the art For example, in the case of a PET film having the above-noted thickness and shrinkage characteristics, formed into bands 14 having the above-noted dimensions, the bands 14 are subjected to four consecutive stations of hot, dry air (about one to about two seconds each at a temperature of about 100 to about 400° F., preferably about 300 to about 400° F., depending on application), and then to a station of steam (about three to about five seconds at a temperature of about 150 to about 200° F.).

The number, order, exposure time and intensity of the heating stations can be varied in a known manner according to the specific dimensions and characteristics of the wrap film and the candle or holder.

Once heat-shrinking is complete, the wrapped candle 25 or holder 20 may be dried if necessary by a conventional air blow-dryer or other known mechanism, at which point the candle 25 is ready for packaging, as is the holder 20 once the candle 25 is positioned therein (step SA(4)).

Although the above-described process is preferred, alternative processes may be used. For example, alternative methods utilizing a preformed loop of film are described in the above-noted Spiegel, et al. patent (in which the loop fits loosely over the object before heat-shrinking) or U.S. Pat. No. 4,225,049 (Inoue) (in which the loop is stretched to fit over the object). The disclosures of both of these patents are incorporated herein by reference in their entireties. An alternative method utilizing a sheet that is wrapped around the object is described in U.S. Pat. No. 5,879,496 (Bright, et al.), the disclosure of which also is incorporated herein by reference in its entirety.

We have found that the present invention provides an additional advantage in that the shrink wrap, when applied, protects the candle holders, which are typically glass. Specifically, the shrink wrap maintains the integrity of and otherwise protects the glass during production or use from, for example, abrasion or scratching. Such scratches significantly reduce the integrity of the glass. Glass, once scratched, loses compression strength and becomes more fragile. The shrink wrap reduces the incidents of such abrasion or scratching, and preserves the integrity of the glass.

While the present invention has been described with respect to what is at present considered to be the preferred embodiments, it should be understood that the invention is not limited to the disclosed embodiments. To the contrary, the invention is intended to cover various modifications and equivalent arrangements, some of which are discussed above, included within the spirit and scope of the appended claims. Therefore, the scope of the following claims is intended to be accorded the broadest reasonable interpretation so as to encompass all such modifications and equivalent structures and functions.

Industrial Applicability

The inventive candle decorating method and product utilize heat-shrinkable films to provide a design that cooperates with the light emitted by the candle to achieve a pleasing, altered or otherwise augmented visual effect, greatly enhancing the aesthetics of the decorative items. The method and product permit greater flexibility than known methods and products to allow a change, easily and cost-effectively, in production from among varied decorative designs.

We claim:

1. A method for decorating a candle product, comprising the steps of:

a). providing a web of a heat-shrinkable polymer having a decorative feature;

b). encasing a candle holder with said web; and c). heating said web to shrink the web to conform to the candle holder;

wherein the web is provided in the form of an elongated sleeve, said web is severed into individual bands each having a decorative feature, and said candle holder is encased by encircling with a band.

2. The method of claim 1, wherein said polymer is poly(ethylene terephthalate), said web is preformed into a sleeve with the orientation of the polymer being circumferential to the sleeve, and said sleeve is severed substantially in the direction of the orientation to form said bands.

3. The method of claim 1, wherein said band is large enough in circumference to fit over said candle holder without being stretched.

4. The method of claim 1, wherein said band is initially not large enough in circumference to fit over said candle holder, and is stretched to fit over said candle holder.

5. The method of claim 1, wherein prior to encasing the candle holder with the band, the candle holder is oriented upside-down on a reference surface, and said encasing step comprises lowering said band in an axial direction to encircle the candle holder and resting the band on said reference surface.

6. The method of claim 1, wherein said encasing step comprises orienting the band in such a manner that upon completion of the heating step, the decorative feature of said band is located so as to cooperate with light emitted by a candle in said candle holder to augment the visual effect when said candle is lit.

7. The method of claim 1, wherein said candle holder comprises glass.

8. The method of claim 7, wherein prior to encasing the candle holder with the band, the candle holder is oriented upside-down on a reference surface, and said encasing comprises lowering said band in an axial direction to encircle the candle holder and resting the band on said reference surface.

9. The method of claim 8, wherein said encasing step comprises orienting the band in such a manner that upon completion of the heating step, the decorative feature of said band is located so as to cooperate with light emitted by a candle in said candle holder to augment the visual effect when said candle is lit.

10. The method of claim 9, wherein said band is large enough in circumference to fit over said candle holder without being stretched.

11. The method of claim 9, wherein said band is initially not large enough in circumference to fit over said candle holder, and is stretched to fit over said candle holder.

12. The method of claim 1, wherein said candle comprises a wick based, hydrocarbon fuel burning illumination device.

13. A method for decorating a candle product, comprising the steps of:

a). providing a web of a heat-shrinkable polymer having a decorative feature;

b). encasing a candle holder with said web; and c). heating said web to shrink the web to conform to the candle holder;

wherein the web is provided in the form of an elongated sleeve, said web is severed into individual panels each having a decorative feature, and said candle holder is encased by wrapping with an individual panel.

14. The method of claim 13, wherein said encasing step comprises orienting the band in such a manner that upon completion of the heating step, the decorative feature of said panel is located so as to cooperate with light emitted by a candle in said candle holder to augment the visual effect when said candle is lit.

15. The method of claim 13, wherein said heat-shrinkable polymer is oriented poly(ethylene terephthalate) having a thickness of approximately 50 microns.

16. The method of claim 15, wherein said candle holder comprises glass.

17. A decorated candle product comprising a candle holder suitable for containing a candle, said candle holder encased in a web of a heat shrunk polymer having a decorative feature located so as to cooperate with light emitted by a candle in said candle holder to augment the visual effect when said candle is lit.

18. A candle product as set forth in claim 17, wherein said candle holder comprises glass.

19. A candle product as set forth in claim 17, wherein said candle comprises a wick based, hydrocarbon fuel burning illumination device.

20. A candle product as set forth in claim 17, wherein said polymer is oriented poly(ethylene terephthalate), and said polymer web has a thickness of approximately 50 microns.

* * * * *